US006309463B1

(12) United States Patent
Hess et al.

(10) Patent No.: US 6,309,463 B1
(45) Date of Patent: Oct. 30, 2001

(54) DEVICE FOR DIRECT OR INDIRECT APPLICATION OF LIQUID OR VISCOUS COATING MEDIUM ONTO A MOVING MATERIAL WEB

(75) Inventors: Harald Hess, Grünkraut; Rüdiger Kurtz, Heidenheim; Benjamin Mendéz-Gallon, Itzelberg, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/563,191

(22) Filed: May 2, 2000

Related U.S. Application Data

(62) Division of application No. 09/229,227, filed on Jan. 12, 1999.

(30) Foreign Application Priority Data

Jan. 13, 1998 (DE) ..... 198 00 954

(51) Int. Cl.[7] ..... B05C 5/00; B05C 1/04

(52) U.S. Cl. ..... 118/302; 118/300; 118/600; 118/203; 118/239; 118/246; 118/249; 118/DIG. 7

(58) Field of Search ..... 118/300, 302, 118/DIG. 7, 600, 203, 239, 246, 248, 249; 427/177, 179, 315, 324, 326, 361, 377, 421, 424

(56) References Cited

U.S. PATENT DOCUMENTS

| | | | | |
|---|---|---|---|---|
| 3,152,918 | | 10/1964 | Kraus | 117/63 |
| 3,785,340 | * | 1/1974 | Stafford et al. | 118/101 |
| 4,915,788 | | 4/1990 | Winheim | 162/207 |
| 5,454,870 | | 10/1995 | Sieberth | 118/258 |
| 5,484,482 | | 1/1996 | Rantanen et al. | 118/203 |
| 5,496,406 | | 3/1996 | Beisswanger et al. | 118/643 |
| 5,536,535 | | 7/1996 | Yamazaki et al. | 427/378 |
| 5,789,031 | | 8/1998 | Hirabayashi et al. | 427/341 |
| 6,063,449 | * | 5/2000 | Koskinen et al. | 427/424 |
| 6,126,750 | * | 10/2000 | Seiz et al. | 118/118 |
| 6,171,653 | * | 1/2001 | Kohl et al. | 427/377 |
| 6,177,137 | * | 1/2001 | Rantanen | 427/348 |

FOREIGN PATENT DOCUMENTS

| | | | |
|---|---|---|---|
| 1 817 912 | 10/1973 | (DE) . | |
| 25 45 901 | 4/1976 | (DE) | B05D/1/26 |
| 32 07 463 C2 | 2/1985 | (DE) | B41F/23/04 |
| 39 35 059 C1 | 2/1991 | (DE) | B05C/9/04 |
| 91 00 291.5 | 5/1991 | (DE) | B05C/11/02 |
| 43 02 435 A1 | 8/1993 | (DE) | D21H/23/56 |
| 42 27 136 C2 | 6/1995 | (DE) | B41M/7/00 |
| 296 21 877U1 | 3/1997 | (DE) | B05C/1/08 |
| 44 02 744C2 | 10/1997 | (DE) | D21H/23/56 |

OTHER PUBLICATIONS

"Advances in Coating Equipment", *Voith Sulzer Paper Technology*, by Dr. M. Kustermann, Mar. 14–15, 1995.

* cited by examiner

*Primary Examiner*—Shrive P. Beck
*Assistant Examiner*—Jennifer Calcagni
(74) *Attorney, Agent, or Firm*—Taylor & Aust, P.C.

(57) ABSTRACT

A device for direct or indirect application of a liquid or viscous coating medium onto a moving material web, specifically a paper or cardboard web, includes an applicator unit which, in the direct application method, applies the coating medium in the form of a coating layer directly onto the material web at a point of application. In the indirect application method, the coating medium is first applied onto an applicator element, for example an applicator roll, which then transfers, at the point of application, the coating medium to the material web in the form of a coating layer. In addition, a drying device for drying of the coating layer is provided downstream from the point of application, viewed in the direction of flow of the material web. In the applicator unit, a device for moistening and/or warming the material web, coating medium or the coating layer is additionally provided before the drying device, viewed in the flow direction of the material web.

26 Claims, 4 Drawing Sheets

DEVICE FOR DIRECT OR INDIRECT APPLICATION OF LIQUID OR VISCOUS COATING MEDIUM ONTO A MOVING MATERIAL WEB

This is a divisional of application Ser. No. 09/229,227 filed Jan 12, 1999.

BACKGROUND OF THE INVENTION

1. Field of the Invention

The present invention relates to a device for direct or indirect application of a liquid or viscous coating medium onto a moving material web, specifically a paper or cardboard web.

2. Description of the Related Art

Devices for direct or indirect coating of a moving material web are generally known in the current state of the art. Reference can be made to the VOITH SULZER article "Advances in Coating Equipment" by Dr. M. Kustermann. This article may be acquired from the assignee under order number P3008.

The process of coating medium application by use of an applicator unit onto the moving material web is generally influenced by a series of disturbing influences. Even when the coating medium is supplied to the material web, irregular air flows across the operating width of the material web that is to be coated may negatively influence the coating result. Particularly at high operating speeds, these air currents originate from the boundary air layer that is carried along by the material web on its surface. It also has a negative effect on the coating result if the absorption capacity of the material web that is to be coated varies in its longitudinal or flow direction, or in its cross direction. This specifically addresses the absorption capacity of the material web, which is at least one factor responsible for how quickly the coating medium dewaters into the material web. It is also detrimental if, based on the given physical characteristics such as surface tension and viscose elasticity, undesirable structures occur in the applied medium. In indirect application methods, there are additional irregularities in the surface structure of the coated material web, resulting for example, from the so-called film splitting effect. In direct application methods—for example when utilizing an open jet nozzle coater with a downstream doctoring device, a "Spray Coating" coater, a "Curtain Coating" coater or similar problems may develop. These problems include effects such as doctoring streaks, grooving when utilizing profiled metering rods, ink splashes or film splitting when utilizing smooth metering rods, and metering rod flooding (this term is generally used for excessive build up of coating medium at the end of a metering rod), which may negatively influence the coating result.

SUMMARY OF THE INVENTION

The present invention further develops an applicator unit of the generic concept so that the negative influence of the previously explained effects upon the achieved coating result are at least reduced, if not entirely eliminated.

An applicator unit is provided which, in the direct application method, applies the coating medium in the form of a coating layer directly onto the material web at an application point. In the indirect application method, the coating medium is first applied onto an applicator element, for example an applicator roll, which then, at an application point, transfers the coating medium to the material web in the form of a coating layer. A drying device for drying of the coating layer is provided downstream from the point of application, viewed in the web flow direction.

A device for moistening and/or warming of the material web and/or the coating medium or the application layer is provided prior to the dryer, when viewed in the direction of material web flow. An advantage of the method according to the invention is to be found in that the coating medium dries slower, thereby reducing its viscose elasticity. The result is that the coating medium remains free-flowing, so that the differences in applied coating thickness and irregularities in the surface structure of the coating layer can be uniformly distributed. Collectively, an independent leveling of the coating layer results. Moistening and/or warming may be effected by use of vapor, preferably water vapor which is caused by evaporation of a liquid in the area of the applicator unit and/or outside the applicator unit and is then supplied to the applicator unit. Additionally, or alternatively, moistening may also occur through spraying of a liquid, preferably water. In addition to a certain level of dilution of the coating medium, the warming of the coating medium that is preferably achieved with vapor also results in a viscosity reduction, which ensures better flow of the coating medium.

The utilization of water, be it in the form of water vapor or in the form of a water spray mist, offers the advantage that the applied water can again be removed in the downstream dryer and, therefore, the structure of the coating layer is not impaired.

The moistening and/or warming device as provided under the invention may be located at one or more of the locations discussed below:

For example, the moistening and/or warming device may be located immediately prior to the point of application, when viewed in direction of web flow. If it releases the vapor or the spray mist in the direction toward the point of application, the material web and the coating medium could be moistened simultaneously. Moistening of the material web reduces variations in its absorption and provides for uniform dewatering of the coating medium into the material web. Moistening and/or warming of the coating medium reduces its surface tension and reduces its viscosity, homogenizing the wetting of the material web with the coating medium and increasing the uniformity of the layer that is to be applied, even prior to the transfer to the material web.

Additionally, the influence of boundary air layer which, particularly at high material web speeds is carried along by the web and impairs the coating result, is reduced.

The moistening and/or warming device which is located before the applicator unit may, for example, include a vapor supply line which, in the area of the applicator unit, is equipped with at least one vapor outlet opening on the side facing the application area. Particularly with a view toward reducing the influence of the boundary air layer that is transported along by the material web, the vapor outlet opening forming side sections of the vapor supply line or of the side sections following the vapor outlet opening, viewed in vapor flow direction, are preferably tapered in the direction of vapor flow. An excessive amount of vapor may be blown into the application nip through this vapor outlet nozzle, so that at least a portion of the introduced vapor will again leave the application area along the material web surface, although in opposite direction to the web flow direction. However, it is also possible to introduce only a sufficient amount of vapor which can be absorbed by the material web and/or the coating medium and which, therefore, can be carried along.

The moistening and/or warming device may also be located following the point of application, viewed in direction of material web flow. For example, in direct application methods, it may be located between the point of application and a device for leveling and/or metering the coating layer which would be installed downstream from the point of application, viewed in direction of web flow. However, it is also possible that the moistening and/or warming device is provided following a device for leveling and/or metering the coating layer, which would be installed downstream from the point of application, viewed in direction of web flow.

When the moistening and/or warming device is installed after the point of application when viewed in direction of material web flow, it is preferable that the moistening and/or warming device directs the vapor or the spray mist substantially orthogonally to the material web surface, since this permits effective moistening of the coating layer surface. In addition, the kinetic energy of the vapor can basically be used for averaging.

For example, the moistening and/or warming device may include a vapor supply line which is equipped with at least one vapor outlet opening in the side section facing the material web.

In order to ensure sufficient moistening of the coating layer, it is further suggested that a vapor outlet section of the vapor supply line extends in direction of material web flow, over a distance of between approximately 0.1 cm and approximately 200 cm, preferably between approximately 50 cm and 100 cm.

The moistening and/or warming device additionally offers the possibility of influencing the transverse or longitudinal profile of the coating layer. A multitude of vapor or spray mist outlet sections can be provided consecutively transversely to the material web, which are independently controllable with regard to the dispensed volume of vapor or spray mist within a given time period.

In order to avoid condensing of the vapor, or settling of spay mist droplets in other than the desired areas of the applicator unit, a suction device may be provided. Since the tendency will exist for the material web to carry along the vapor or the spray mist with its movement, the suction device is located following the moistening and/or warming device, viewed in direction of material web flow.

In the instance of the previously discussed moistening and/or warming device which is located before the point of application, the suction device may also be arranged before the moistening and/or warming device, viewed in direction of material web flow.

When utilizing a leveling and/or metering device, a collecting device for excess coating medium is generally allocated to this unit. Through simple design modifications, this collecting device may also be utilized as a suction device at the same time.

It is also possible that the moistening and/or warming device is located at a distance from the point of application, relative to the direction of web flow. Treatment by moistening or warming may be useful even a long distance before the point of application if the design characteristics of the applicator unit demand this, or if an indirect application method is selected whereby a smooth and uniform coating application onto the applicator element can considerably influence the coating result on the material web. Thus, in the indirect application method, the moistening and/or warming device is located in the area of the applicator element. In this arrangement, the moistening and/or warming device may be installed at a location where the coating medium is applied to the applicator element. Regular metering and/or leveling of the coating layer which is applied to the applicator element occurs with indirect application. The moistening and/or warming device may then be placed at a location where the coating medium that is applied to the coating element is metered and/or leveled.

Generally, metering rods are utilized as well as doctoring blades for metering and/or leveling. Good results have been achieved if initially only the metering rod is moistened or warmed and the coating medium is moistened and warmed indirectly by the moistened or warmed metering rod. The applicator device includes at least one metering rod for metering and/or leveling of the coating medium on the applicator element or the material web, and the moistening and/or warming device moistens and/or warms the metering rod in an area remote from the point of engagement with the applicator element or the material web.

Generally, the metering rod is mounted substantially along its entire length in a metering rod bed. A simple design solution for moistening or warming the metering rod is that it may be moistened and/or warmed via a channel system running through the metering rod bed and which is open toward a bearing surface for the metering rod. Simple sluices may be used for the channel system, which are often already present in conventional metering rod beds.

In addition, the current invention relates to a method for direct or indirect application of a liquid or viscous coating medium onto a moving material web, specifically a paper or cardboard web. Regarding the advantages that are achievable with the method according to the current invention, reference can be made to the previous discussion on the applicator unit in accordance with the current invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
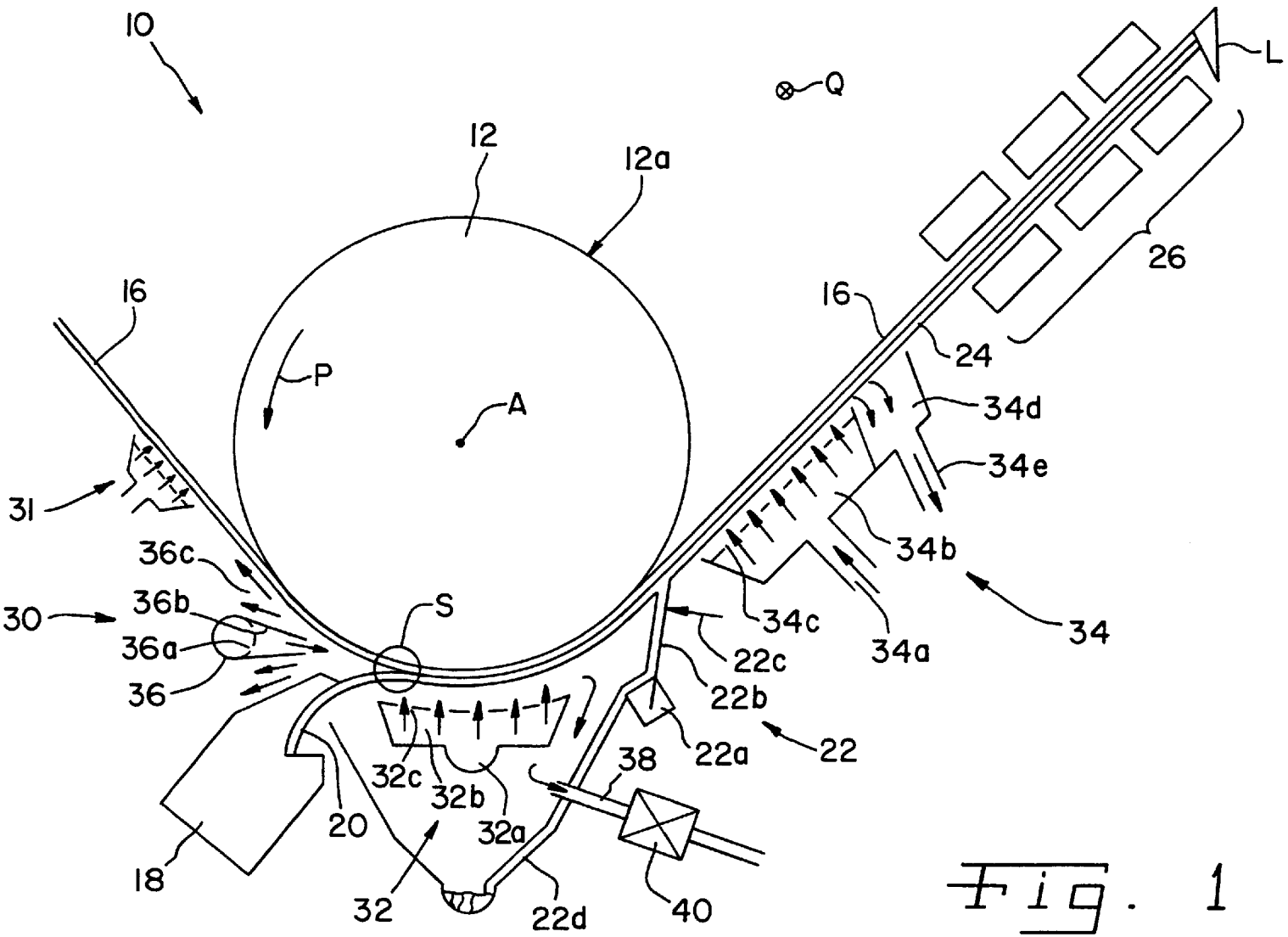
FIG. 1 is a rough, schematic, side view of one embodiment of an applicator device according to the current invention for single sided, direct coating of a material web.

Referring now to the drawings and particularly to FIG. 1, there is shown an applicator device according to the present invention, generally identified with 10. The applicator device 10 serves to directly apply a liquid or viscous medium 20 onto material web 16 which is moving in the direction of the arrow L, whereby the web is guided around a backing roll 12 in the area of the applicator device 10. The backing roll 12 rotates around its axis A in direction of arrow P.

The applicator device 10 includes an applicator unit 18, for example an open jet nozzle coater which generally applies an excess of coating medium onto the material web 16 at an application point S. Since open jet nozzle coaters are basically well known, we can refer to the current state of the art with respect to their design and operation. Obviously, other types of applicator units, such as for example "Curtain Coating" or "Spray Coating" units may be utilized in place of the open jet nozzle coater 18.

A leveling and/or metering device 22 (subsequently referred to as "doctoring device" for short) is provided following the point of application S, viewed in flow direction L, which includes a doctor blade 22*b* mounted on a blade beam 22*a*. The doctor blade 22*b* is adjusted against the material web 16, or the coating layer 24, whereby the contact pressure or contact force may be adjusted by use of an adjusting device. Such doctoring devices are known in the art and need not be explained here in further detail.

Following the doctoring device 22 as viewed in flow direction L of material web 16, a dryer arrangement 26 is provided which at least partially removes moisture contained in material web 16 and coating layer 24. Regarding design and operation of such essentially known drying devices, we again refer to the state of the art.

According to the current invention, an initial moistening and/or warming device 30 which is located prior to the application point S, viewed in flow direction L of material web 16, is provided for the applicator device 10. In addition, a second moistening and/or warming device 32 is provided between the application point S and the doctoring device 22. Finally, a third moistening and/or warming device 34 is provided between the doctoring device 22 and the dryer device 26. However, not all three moistening and/or warming devices 30, 32 and 34 need be present in each instance. That is, only one or two of these three moistening and/or warming devices 30, 32, 34 may be provided in other embodiments.

The example illustrated in FIG. 1 shows all three moistening and/or warming devices 30, 32, 34 in the form of vaporizing units which release vapor, preferably water vapor, onto the material web 16, coating medium 20, or the coating layer 24. Preferably, a saturated or overheated water vapor is used.

The moistening and/or warming device 30 includes a vapor supply pipe 36 which is equipped with vapor discharge openings 36*a* on its side facing the point of application S. A nozzle body 36*b*, which tapers toward the direction of application point S, connects to these vapor discharge openings 36*a* and preferably extends to immediately before the application point S. In a preferred arrangement, the vapor is supplied by the moistening and/or warming device 30 to the area before the application point S in such volumes that at least a portion of this vapor exits this area in opposite direction to the direction of flow L of material web 16, as indicated by arrows 36*c* in FIG. 1. This prevents the boundary air layer that is carried along by the material web 16 from reaching the application point S and influencing the coating result. However, it is also possible for the moistening and/or warming device 30 to release the vapor only onto the coating medium 20, while a separate moistening and/or warming device 31 releases vapor only onto the material web 16.

The moistening and or warming device 32 located between the application point S and the doctoring device 22 includes a supply section 32*a* and a distribution section 32*b*. The side of distributor section 32*b* facing the material web 16 includes a multitude of vapor discharge openings 32*c* from which vapor is supplied substantially orthogonally to the material web 16 or the coating layer 24, as indicated in FIG. 1 by five small arrows. With a view toward a simple and cost effective design, the moistening and/or warming device 32 is preferably constructed of sheet metal.

The moistening and/or warming device 34 which is located between the doctoring device 22 and the dryer 26 is of similar construction as the moistening and/or warming device 32. Vapor is supplied through a supply line 34*a* to a distributor section 34*b* from which the vapor is released, substantially orthogonally, onto the coating layer 24. The moistening and/or warming device 34 is also preferably constructed of sheet metal.

The vapor supplied to the material web 16 or to the coating layer 24 is carried along by the material web in direction of flow L, if it is not absorbed by the web, thereby leaving the area of the moistening and/or warming device. As mentioned previously, flowing off of the vapor in opposite direction to flow direction L is even desirable in the moistening and/or warming device 30. The escaping vapor may deposit itself in cool areas of the applicator device 10 or in other parts along the entire length and may lead to undesirable condensate formation there. In order to guard against this effect, or in order to prevent this effect, vapor suction devices may be allocated to the moistening and/or warming devices 30, 32, 34. For example, the sheet metal construction of the moistening and/or warming device 34 is equipped with a suction section 34*d*, which is located immediately following the distributor section 34*b*, as viewed in flow direction L of material web 16. The extracted vapor can be removed from the suction section 34*d* through a suction line 34*e* which, if desired, may be equipped with a blower.

With the moistening and/or warming device 32 located between the application point S and the doctoring device 22, the suction device may be constructively formed particularly simply by the collecting device 22*d* and the doctoring device 22. In this arrangement, the metered off coating medium may be thinner due to condensate. This may be tolerated especially because the metered off coating medium is thickened somewhat compared to the coating medium that is applied to the material web since the material web—due to its absorption properties—removes moisture from the coating medium applied to it. It is, however, also possible to provide a suction pipe 38, reaching into the collecting device 22*d*, to which a blower 40 can be connected.

A suction device may also be allocated to the moistening and/or warming devices 30 and 31, even though this has been left off the illustration in FIG. 1 in order to provide better clarity. For reasons of space, this suction device is located before devices 30 or 31, viewed in flow direction L of material web 16.

Figure 2:
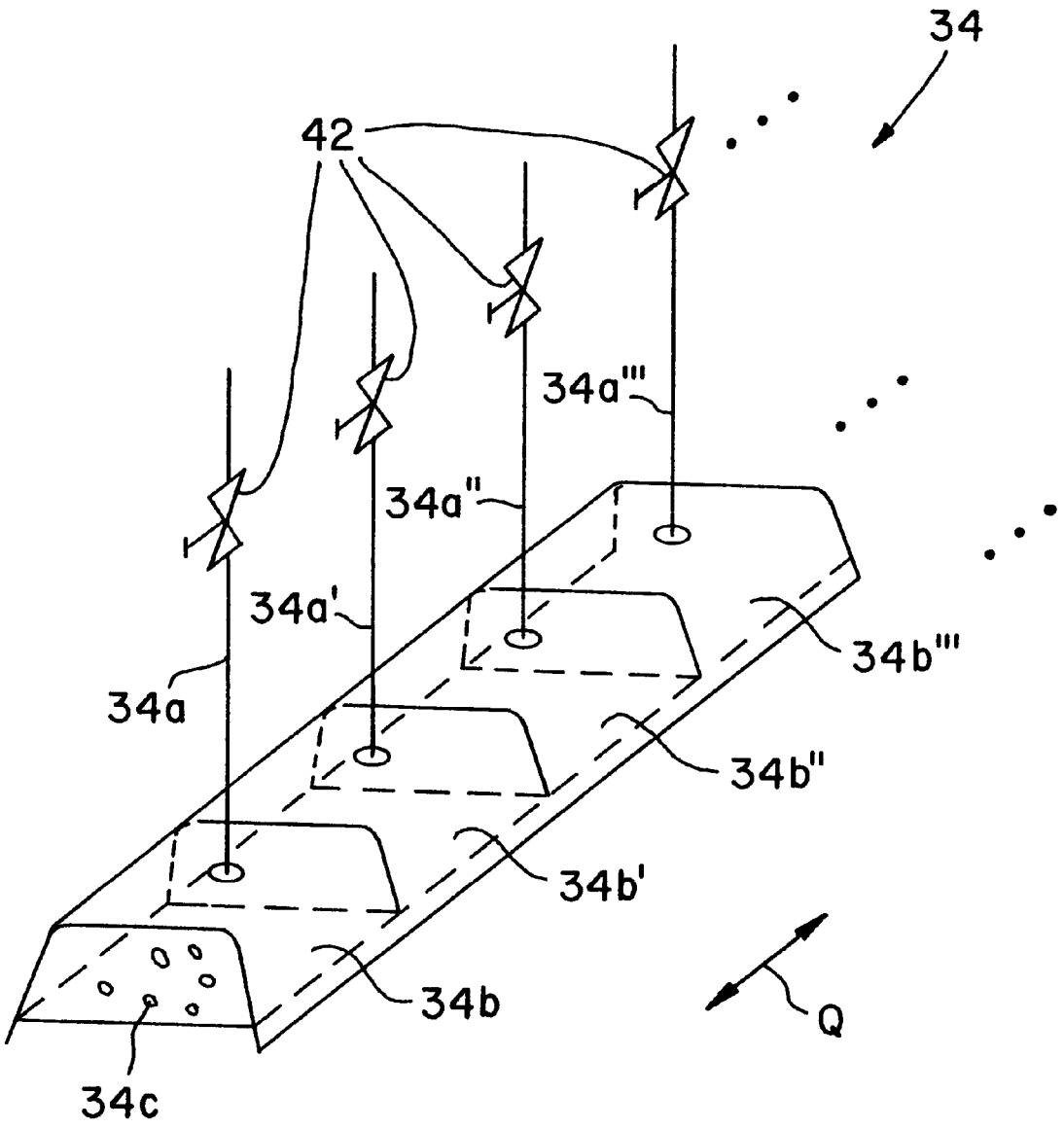
FIG. 2 is a schematic illustration of one embodiment of a moistening and/or warming device, with which transverse successive segments of the material web may be moistened at different levels.

In order to permit zoned vaporizing of the application layer 24 in transverse direction Q of the material web 16, the moistening and/or warming devices may be equipped with a multitude of vapor outlet openings 34*b*, 34*b*', 34*b*", 34*b*'" . . . , to which separate vapor supply lines 34*a*, 34*a*', 34*a*", 34*a*'" . . . are allocated, as illustrated in FIG. 2 of the moistening and/or warming device 34. The volume flow of the vapor supplied by the vapor supply lines 34*a*, 34*a*' . . . may be influenced by non-illustrated control units including only schematically depicted valve units 42. The vaporizing cross profile in the moistening and/or warming devices 30, 31 and 32 may of course, also be varied analogically.

Figure 3:
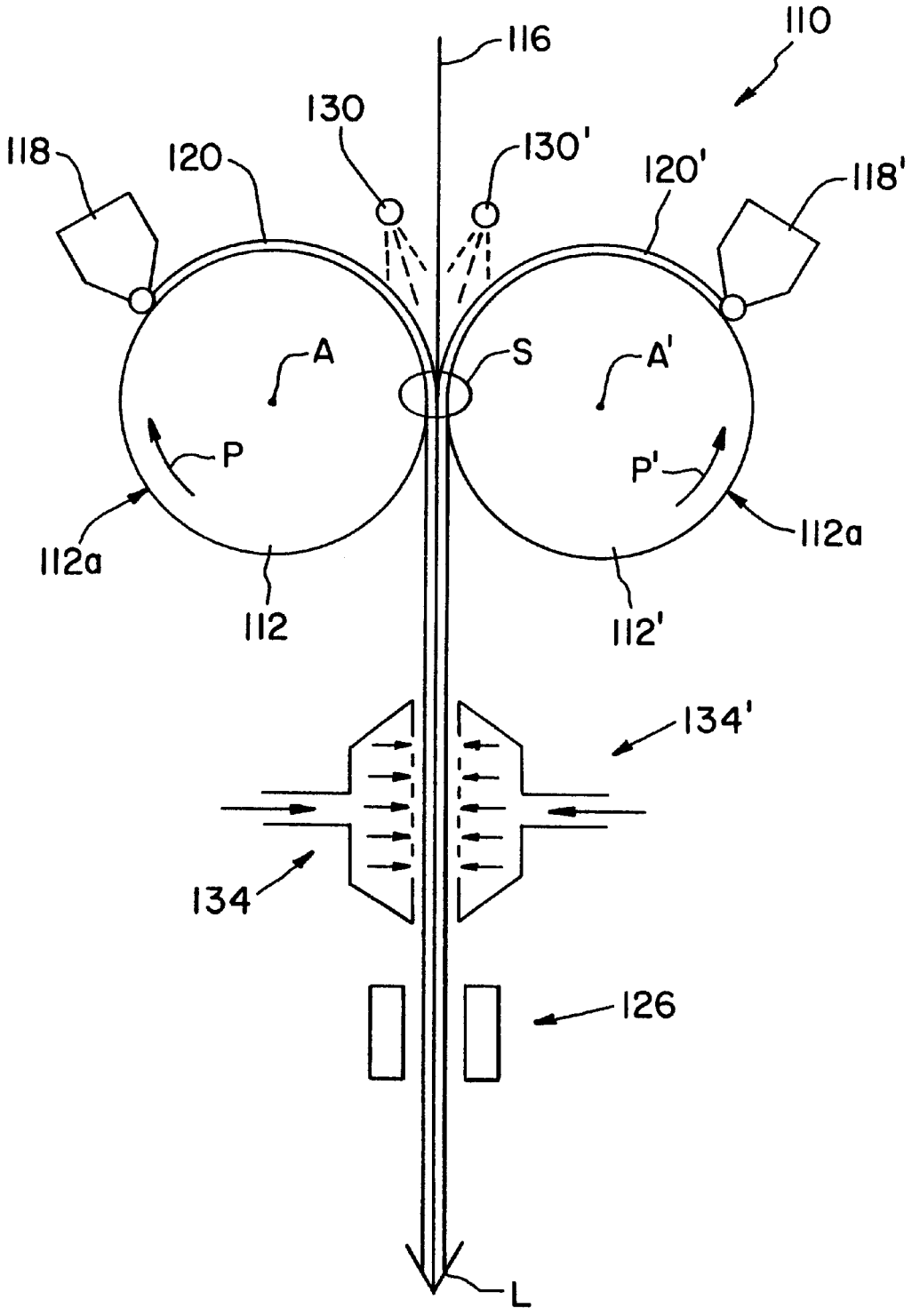
FIG. 3 is a rough, schematic, side view of another embodiment of an applicator device according to the current invention, for two-sided coating of a material web.

The applicator device 110 illustrated in FIG. 3 serves for double sided indirect application of liquid or viscous coating medium 120, 120' onto a material web 116 which is moving in flow direction L. This applicator device 110 includes two coating units 118, 118' which apply the liquid or viscous coating medium 120, 120' onto the surface 112*a* or 112*a*' of two applicator rolls 112, 112'. The two applicator rolls 112, 112' together form or define an application nip through which the material web 116 runs. The applicator rolls 112, 112' rotate around their respective axes A and A' in direction of the arrows P and P', so that they are in contact with material web 116 substantially skid and slip free. Through the rotation of the applicator rolls 112, 112' the coating medium 120, 120' is transported from the applicator units 118 and 118' to the material web 116. In accordance with FIG. 1, a dryer 126 is provided after the applicator device 110, following the application point S when viewed in flow direction L.

Similar to the arrangement in FIG. 1, moistening and/or warming devices 130, 130' and 134, or 134' are provided before the application point S, and the dryer 126, respectively. The moistening and/or warming devices 134 and 134' correspond in their design and function to the moistening and/or warming devices according to FIG. 1, to the description of which we refer herewith.

Unlike the moistening and/or warming device 30 of the design according to FIG. 1, the moistening and/or warming devices 130, 130' do not release vapor in the direction of the application point S, but instead deliver a spray mist of finely atomized liquid drops. Again, the state of the art is known for utilization of suitable atomizers as a moistening and/or warming devices 130 and 130' and will, therefore, not be discussed in further detail here.

Only one design form for single sided direct application and one design form for double sided indirect application has been illustrated and discussed herein. Furthermore, a vaporizing device is shown only in the last mentioned design form, and only in the flow direction prior to the point of application S. However, it is to be understood that the current invention also relates to design forms for double sided direct application, single sided indirect application, or even combined direct and indirect application. Further, each of the aforementioned devices 30, 31, 32, 34, 130, 130', 134, 134' may further be arranged as a device producing and/or supplying vapor, or as a device for atomizing liquid, or as a combination of these device types.

Figure 4:
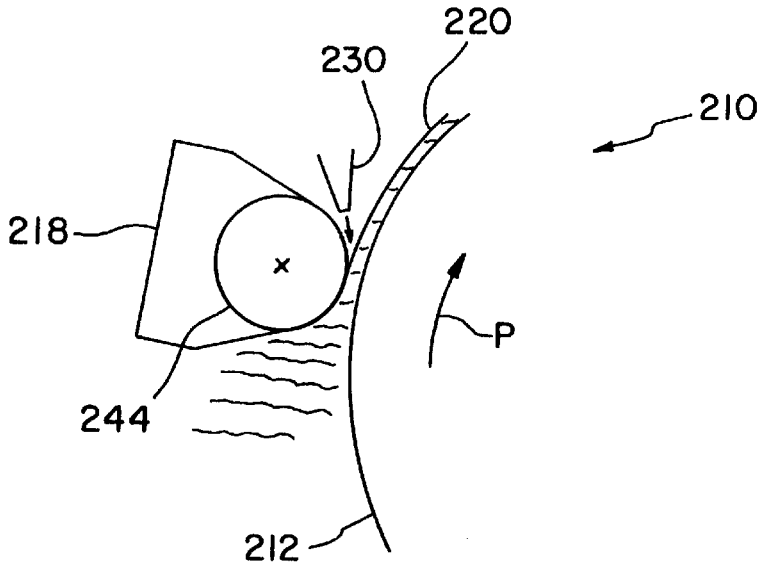
FIG. 4 is a rough, schematic, side view of another embodiment of a section of the applicator device according to the current invention for indirect coating of a material web, whereby moistening and/or warming occurs in the area of a transfer roll of the applicator unit.
Figure 5:
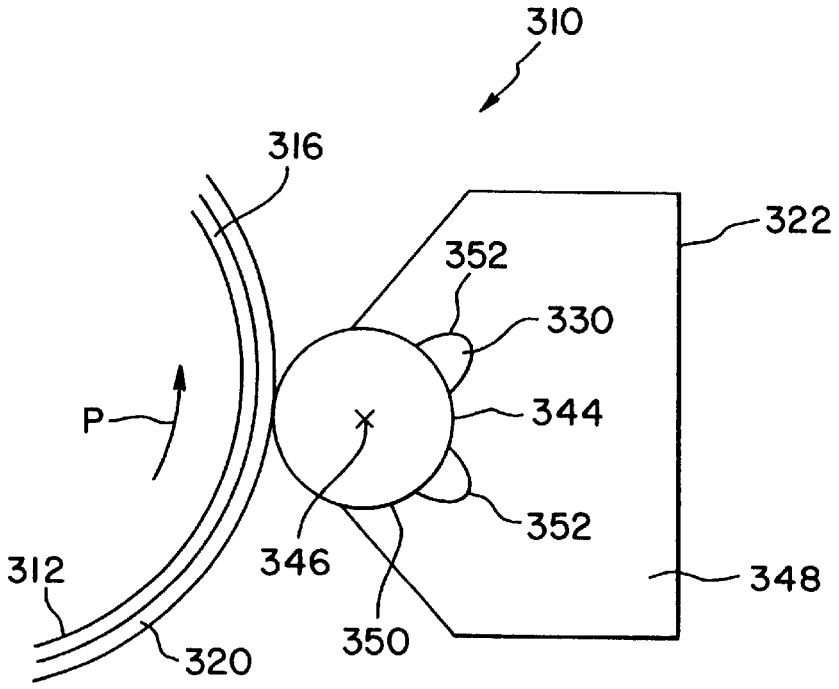
FIG. 5 is a rough, schematic, side view of another embodiment of an applicator device whereby a metering rod is moistened and/or warmed.

We will now discuss FIG. 4 and 5. For the identification of identical or identically functioning components as illustrated in FIGS. 1 through 3, the same reference numbers are used, but are increased by 100 or by integral multiples of 100. Regarding the description of such components, reference can be made to the preceding descriptions of FIGS. 1 through 3.

FIG. 4 illustrates a section of an applicator device 210 which serves to indirectly apply liquid or viscous medium 220 onto a material web which is not illustrated in detail. The coating medium 220 is initially applied by use of an applicator unit 218 onto an applicator and transfer roll 212 which rotates in direction of arrow P. The coating medium 220 that has been applied to the transfer roll 212 is moistened and/or warmed by use of a moistening and/or warming device 230. The moistening and/or warming device 230, which is schematically depicted as a nozzle, is directed toward a nip between the transfer roll 212 and a metering rod 244. Metering rod 244 serves as the doctoring element for metering the layer thickness of the applied coating medium 220. In relation to the direction of rotation of the transfer roll 212, the moistening and/or warming device 230 is located after the metering rod 244. Moistening and/or warming device 230 favors uniform distribution of the coating medium 220 on the transfer roll 212 so that there are substantially identical application conditions at the transfer point, which is not illustrated in detail, where the coating medium is transferred to the material web, across the entire width of the transfer roll 212 and the material web, as well as in longitudinal direction of the material web. In addition, the nozzle type moistening and/or warming device 230, which is directed toward the nip between metering rod 244 and transfer roll 212, prevents so-called film splitting whereby parts of the coating medium which is to be applied to the transfer roll 212 adhere to the metering rod 244.

FIG. 5 illustrates a backing roll 312, rotating in direction of an arrow P, which in part of its circumference is in contact with a material web 316 which is covered with a layer of a coating medium 320. The coated material web 316 runs through a doctoring device 322 which removes excess coating medium 320 from the material web 316 by use of a metering rod 344. The metering rod 344 rotates around its rod axis 346 and is mounted in a metering rod bed 348, substantially along its entire length. For this purpose, the metering rod bed 348 is equipped with a partially cylindrical bearing surface 350 against which the metering rod 344 supports itself. Channels 352 are incorporated in the bearing surface 350 along the metering rod 344 which are open toward the metering rod 344 either along their entire length or have outlet openings distributed along the length of the metering rod 344. The channels 352 are part of a moistening and/or warming device 330 which supplies vapor or a spray liquid through the channels 352 onto the outside surface of the metering rod 344. The metering rod 344, rotating in the metering rod bed 348, carries the moisture and/or warmth into the area of its contact with the material web 316, where the moisture and/or warmth are at least partially transferred to the coating medium 320 and the material web 316. Obviously, a nozzle arrangement directed into the nip between metering rod 344 and roll 312 may additionally be provided through which moistening and/or warming of the coating medium 320 and the material web 316 can be achieved by vaporizing or spraying.

Since the channels 352 are already available on conventional metering rod beds and serve as flushing channels, a conventional metering rod bed may substantially be utilized without modifications in order to achieve the arrangement in FIG. 5. Thus, manufacturing and design expenditures may be kept low.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for directly applying a coating medium onto a moving fiber material web having a direction of movement, said apparatus comprising:

an applicator unit configured for directly applying a layer of the coating medium onto the fiber web at an application point;

a drying device disposed after said application point relative to the direction of movement of the fiber web, said drying device being configured for drying the coating layer;

at least one primary moistening/warming device disposed before said drying device relative to the direction of movement of the fiber web, said moistening/warming device being configured for at least one of moistening and warming at least one of the fiber web, the coating medium and the coating layer; and at least one secondary moistening/warming device, being configured solely to direct at least one of moisture and heat toward at least one of the fiber web, the coating medium and the coating layer, each said secondary moistening/warming device including a housing defining a chamber and a source of at least one of heat and moisture, said chamber being open and directed toward at least one of the fiber web, the coating medium and the coating layer.

2. The apparatus of claim 1, wherein at least one of said at least one of primary moistening/warming device and said at least one secondary moistening/warming device comprises a vapor device configured for at least one of production and supply of water vapor.

3. The apparatus of claim 1, wherein at least one of said at least one primary moistening/warming device and said at least one secondary moistening/warming device comprises a spray device configured for spraying water.

4. The apparatus of claim 1, wherein at least one of said at least one primary moistening/warming device and said at least one secondary moistening/warming device is disposed immediately before said application point relative to the direction of movement of the fiber web.

5. The apparatus of claim 4, wherein at least one of said at least one primary moistening/warming device and said at least one secondary moistening/warming device is configured for emitting one of a vapor and a spray mist toward said application point.

6. The apparatus of claim 5, wherein at least one of said at least one primary moistening/warming device and said at least one secondary moistening/warming device includes a vapor supply line configured such that at least one vapor outlet is directed toward said application point.

7. The apparatus of claim 6, wherein a nozzle body attaches to said vapor supply line, said nozzle body being directed toward said application point and being tapered in a direction of vapor flow.

8. The apparatus of claim 1, wherein at least one said secondary moistening/warming device is disposed after said application point relative to the direction of movement of the fiber web.

9. The apparatus of claim 8, further comprising a doctor device disposed after said application point relative to the direction of movement of the fiber web, said doctor device being configured for at least one of metering and leveling of the coating layer, at least one said secondary moistening/warming device being disposed between said application point and said doctor device.

10. The apparatus of claim 8, further comprising a doctor device disposed between said application point and at least one said secondary moistening/warming device, said doctor device being configured for at least one of metering and leveling of the coating layer.

11. The apparatus of claim 8, wherein at least one of said at least one primary moistening/warming device and said at least one secondary moistening/warming device is configured for emitting one of a vapor and a spray mist in a direction substantially orthogonal to the fiber web.

12. The apparatus of claim 8, wherein at least one of said at least one primary moistening/warming device and said at least one secondary moistening/warming device includes a vapor supply line having a first side section facing the fiber web, said vapor supply line having at least one vapor outlet opening in said first side section.

13. The apparatus of claim 8, wherein said vapor supply line includes a vapor outlet section having a width oriented substantially parallel to the direction of movement of the fiber web, said width being approximately between 0.1 cm and 200 cm.

14. The apparatus of claim 13, wherein said width of said vapor outlet section is approximately between 60 cm and 100 cm.

15. The apparatus of claim 1, wherein the fiber web has a width, said apparatus further comprising one of a plurality of vapor outlet sections and a plurality of spray mist outlet sections aligned in a direction substantially parallel to the width of the fiber web, a flow rate of said outlet sections being independently controllable.

16. The apparatus of claim 1, further comprising a suction device.

17. The apparatus of claim 16, wherein said suction device is disposed after at least one said secondary moistening/warming device relative to the direction of movement of the fiber web.

18. The apparatus of claim 16, further comprising:

a doctor device configured for at least one of leveling and metering the coating layer; and a coating medium collecting device associated with said doctor device, said collecting device being in fluid communication with said suction device.

19. An apparatus for indirectly applying a coating medium onto a moving fiber material web having a direction of movement, said apparatus comprising:

an applicator roll configured for applying a layer of the coating medium onto the fiber web at an application point;

an applicator unit associated with said applicator roll, said applicator unit being configured for applying the coating medium onto said applicator roll;

a drying device disposed after said application point relative to the direction of movement of the fiber web, said drying device being configured for drying the coating layer;

at least one primary moistening/warming device disposed before said drying device relative to the direction of movement of the fiber web, said moistening/warming device being configured for at least one of moistening and warming at least one of the fiber web, the coating medium and the coating layer; and at least one secondary moistening/warming device, being configured solely to direct at least one of moisture and heat toward at least one of the fiber web, the coating medium and the coating layer, each said secondary moistening/warming device including a housing defining a chamber and a source of at least one of heat and moisture, said chamber being open and directed toward at least one of the fiber web, the coating medium and the coating layer.

20. The apparatus of claim 19, wherein at least one said primary moistening/warming device is disposed before and at a distance away from said application point.

21. The apparatus of claim 20, wherein at least one said primary moistening/warming device is disposed adjacent to said applicator roll.

22. The apparatus of claim 21, wherein said applicator roll includes a receiving point configured for receiving the coating medium from said applicator unit, at least one said primary moistening/warming device being disposed adjacent to said receiving point of said applicator roll.

23. The apparatus of claim 21, wherein said applicator unit includes a doctor device configured for at least one of metering and leveling the coating medium on the applicator roll, at least one said secondary moistening/warming device being disposed adjacent to said doctor device of said applicator unit.

24. The apparatus of claim 23, wherein said doctor device comprises at least one metering rod having a length, a bearing surface and a point of engagement with said applicator roll, said at least one metering rod having an area remote from said point of engagement, at least one said secondary moistening/warming device being configured for at least one of moistening and warming said remote area of said at least one metering rod.

25. The apparatus of claim 24, further comprising a metering rod bed having a channel system extending through said metering rod bed, said at least one metering rod being mounted in said metering rod bed substantially along said length of said at least one metering rod such that said channel system opens toward said bearing surface of said at least one metering rod, at least one said secondary moistening/warming device being configured for at least one of moistening and warming said least one metering rod through said channel system of said metering rod bed.

26. The apparatus of claim 1, wherein at least one of said at least one primary moistening/warming device and said at least one secondary moistening/warming device is configured to deliver a spray mist of liquid droplets.

* * * * *